US005282459A

United States Patent [19]

Soule

[11] Patent Number: 5,282,459

[45] Date of Patent: Feb. 1, 1994

[54] FIREPLACE SHIELD

[76] Inventor: James E. Soule, 92 Sea Lion Dr., Mayville, N.Y. 14757

[21] Appl. No.: 24,089

[22] Filed: Mar. 1, 1993

[51] Int. Cl.[5] ..... F24B 1/195

[52] U.S. Cl. ..... 126/552; 126/500; 126/521

[58] Field of Search ..... 126/500, 521, 553, 552, 126/540, 541, 152 B, 152 R

[56] References Cited

U.S. PATENT DOCUMENTS

| | | | |
|---|---|---|---|
| 951,020 | 3/1910 | Murphy | 126/553 |
| 1,617,473 | 2/1927 | Axford | 126/553 |
| 4,759,340 | 7/1988 | Chong | 126/541 |
| 4,886,047 | 12/1989 | Bonin | 126/500 |

FOREIGN PATENT DOCUMENTS

| | | | |
|---|---|---|---|
| 2577660 | 8/1986 | France | 126/552 |

*Primary Examiner*—James C. Yeung
*Attorney, Agent, or Firm*—Leon Gilden

[57] ABSTRACT

A shield structure is arranged in mounted communication with a fireplace grate in adjacency to a rear wall of a fireplace to afford protection to the fire bricks of the fireplace rear wall minimizing their deterioration. The shield structure is arranged to include abutment portions to a rear face of the shield arrangement to provide for a spaced relationship of the shield relative to the fireplace rear wall to provide for an air barrier between the shield and the rear wall.

3 Claims, 4 Drawing Sheets

FIREPLACE SHIELD

BACKGROUND OF THE INVENTION

1. Field of the Invention

The field of invention relates to shield apparatus, and more particularly pertains to a new and improved fireplace shield arranged in adjacency to a fireplace hearth rear wall to afford protection to the fire bricks of the rear wall structure.

2. Description of the Prior Art

In the continued use of fireplaces, the rear wall is subject to deterioration relative to the constant projection of heat to the rear wall. The instant invention attempts to overcome deficiencies of the prior art by providing for a shield member having abutment portions to space a fireplace shield relative to the hearth rear wall and in this respect, the present invention substantially fulfills this need.

A prior art fireplace organization, typically found in the prior art, is indicated in U.S. Pat. No. 5,014,683 wherein a fireplace is provided with a grate structure within a self-enclosed fireplace assembly.

SUMMARY OF THE INVENTION

In view of the foregoing disadvantages inherent in the known types of fireplace apparatus now present in the prior art, the present invention provides a fireplace shield wherein the same is mounted to a fireplace grate to position the fireplace shield in adjacency to the grate affording protection to the rear wall of the fireplace hearth. As such, the general purpose of the present invention, which will be described subsequently in greater detail, is to provide a new and improved fireplace shield which has all the advantages of the prior art fireplace apparatus and none of the disadvantages.

To attain this, the present invention provides a shield structure arranged in mounted communication with a fireplace grate in adjacency to a rear wall of a fireplace to afford protection to the fire bricks of the fireplace rear wall minimizing their deterioration. The shield structure is arranged to include abutment portions to a rear face of the shield arrangement to provide for a spaced relationship of the shield relative to the fireplace rear wall to provide for an air barrier between the shield and the rear wall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fireplace shield which has all the advantages of the prior art fireplace apparatus and none of the disadvantages.

It is another object of the present invention to provide a new and improved fireplace shield which may be easily and efficiently manufactured and marketed.

It is a further object of the present invention to provide a new and improved fireplace shield which is of a durable and reliable construction.

An even further object of the present invention is to provide a new and improved fireplace shield which is susceptible of a low cost of manufacture with regard to both materials and labor, and which accordingly is then susceptible of low prices of sale to the consuming public, thereby making such fireplace shields economically available to the buying public.

Still yet another object of the present invention is to provide a new and improved fireplace shield which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
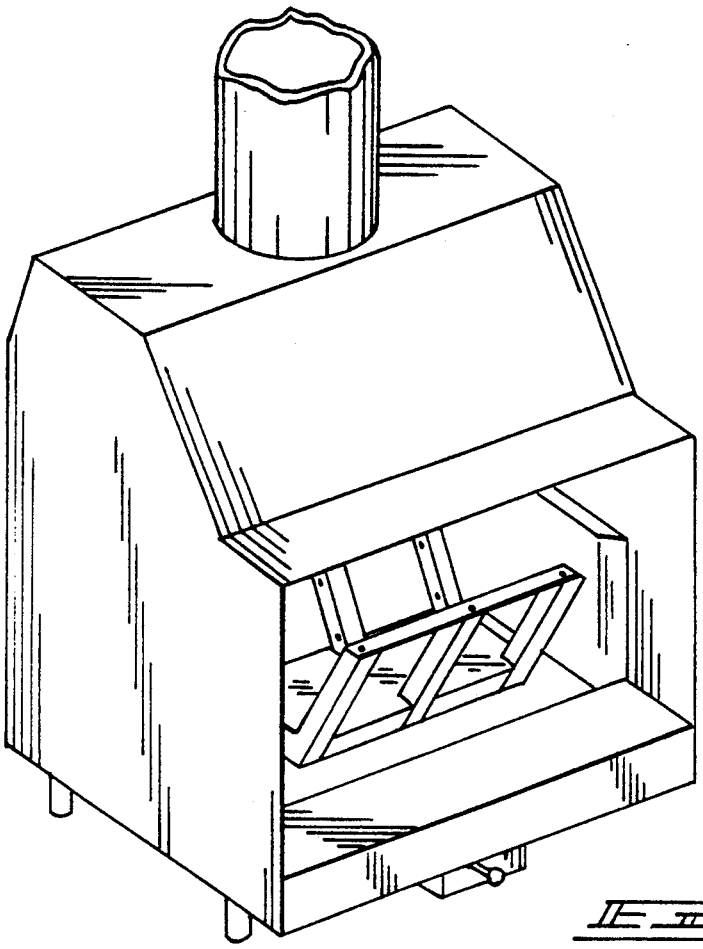
FIG 1 PRIOR ART
FIG. 1 is an isometric illustration of a typical prior art fireplace structure.

With reference now to the drawings, and in particular to FIGS. 1 to 8 thereof, a new and improved fireplace shield embodying the principles and concepts of the present invention and generally designated by the reference numeral 10 will be described.

FIG. 1 illustrates a conventional prior art fireplace structure, such as illustrated and directed in the U.S. Pat. No. 5,014,683.

Figure 2:
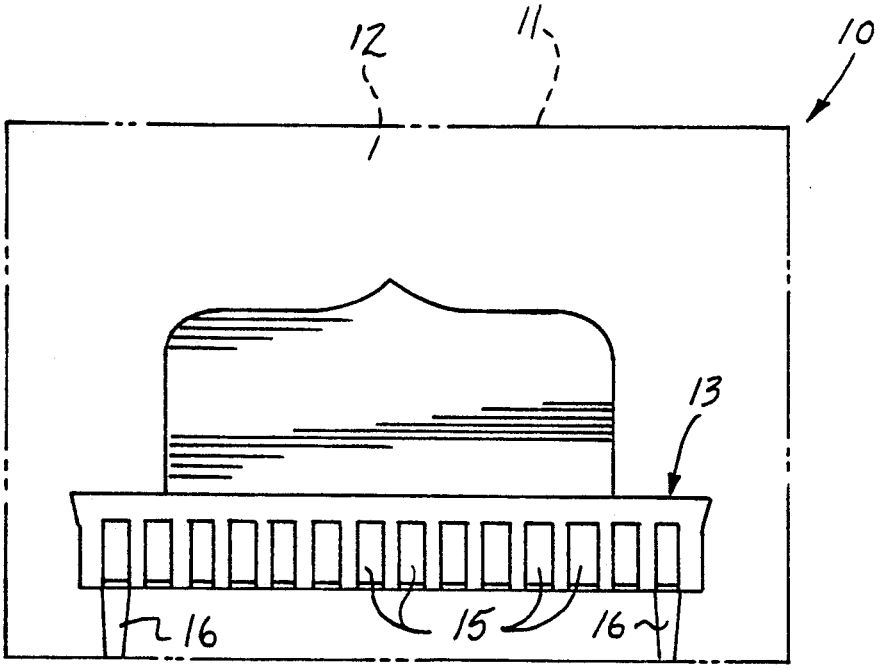
FIG. 2 is an orthographic view of the apparatus.
Figure 3:
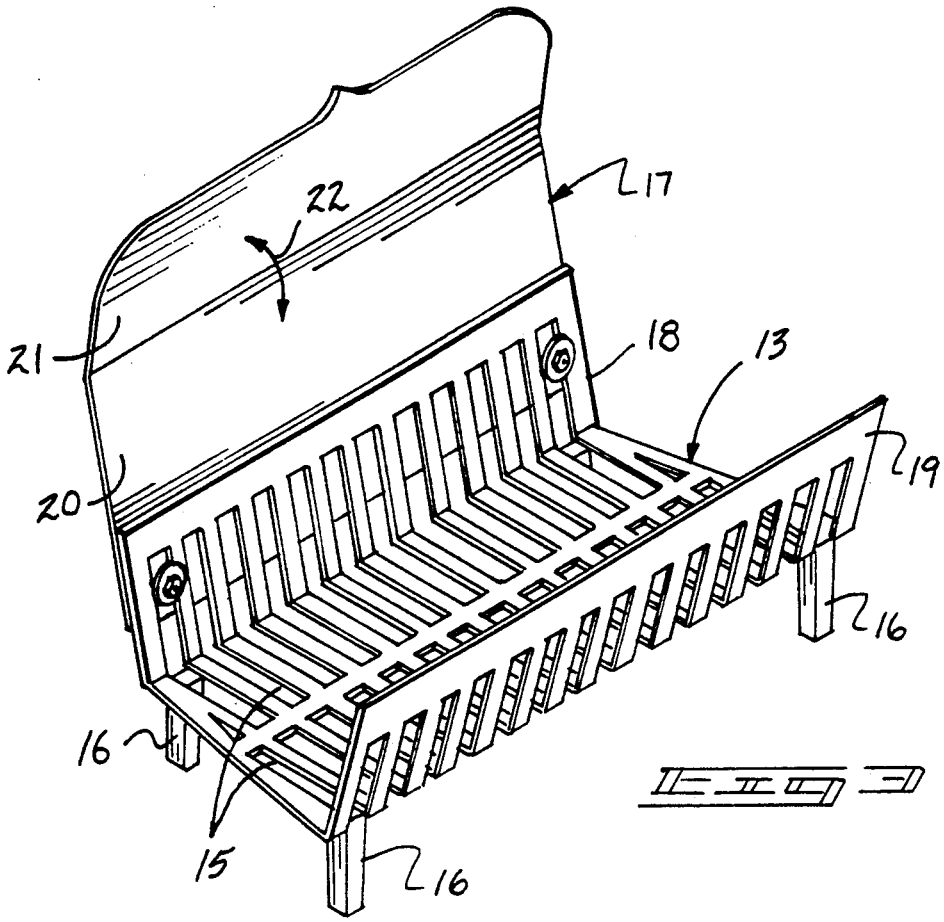
FIG. 3 is an isometric illustration of the invention.
Figure 4:
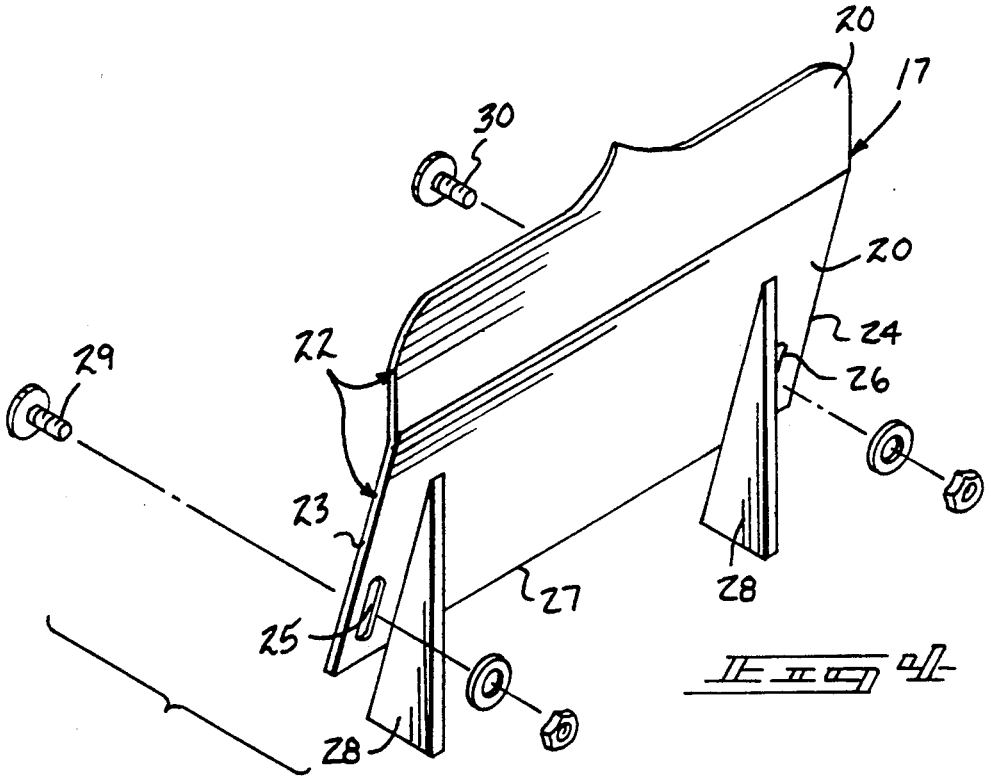
FIG. 4 is an orthographic rear view of the shield structure.
Figure 5:
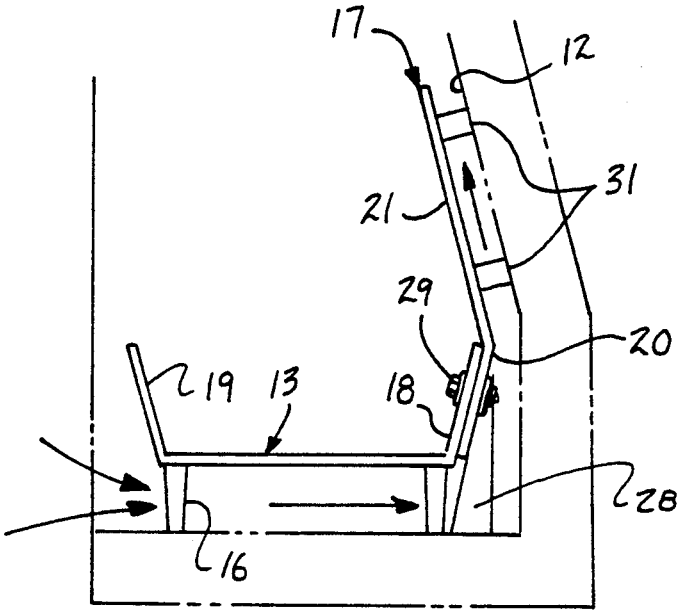
FIG. 5 is an orthographic side view of the shield structure employing abutment lugs mounted to an uppermost plate member of the shield construction.
Figure 6:
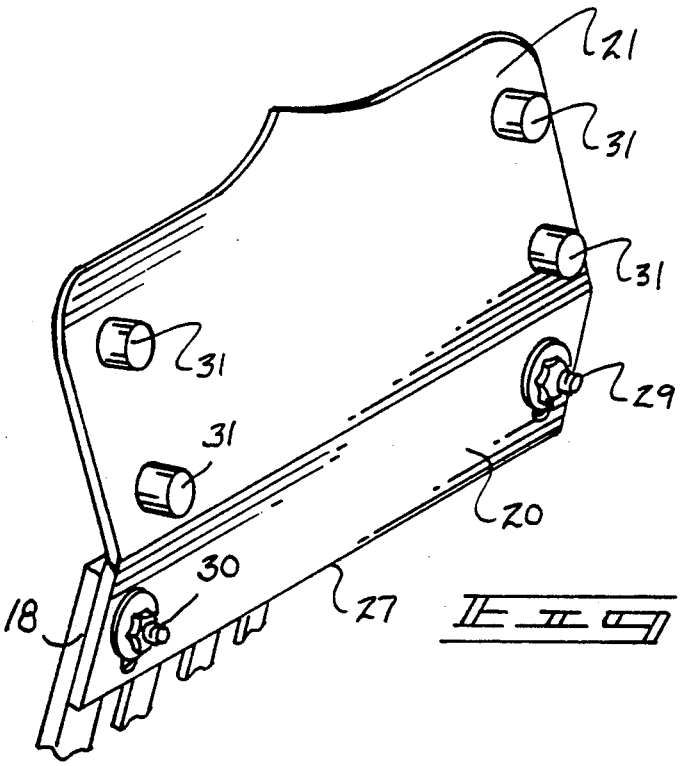
FIG. 6 is an isometric illustration of the shield construction illustrating the lugs mounted thereon.
Figure 7:
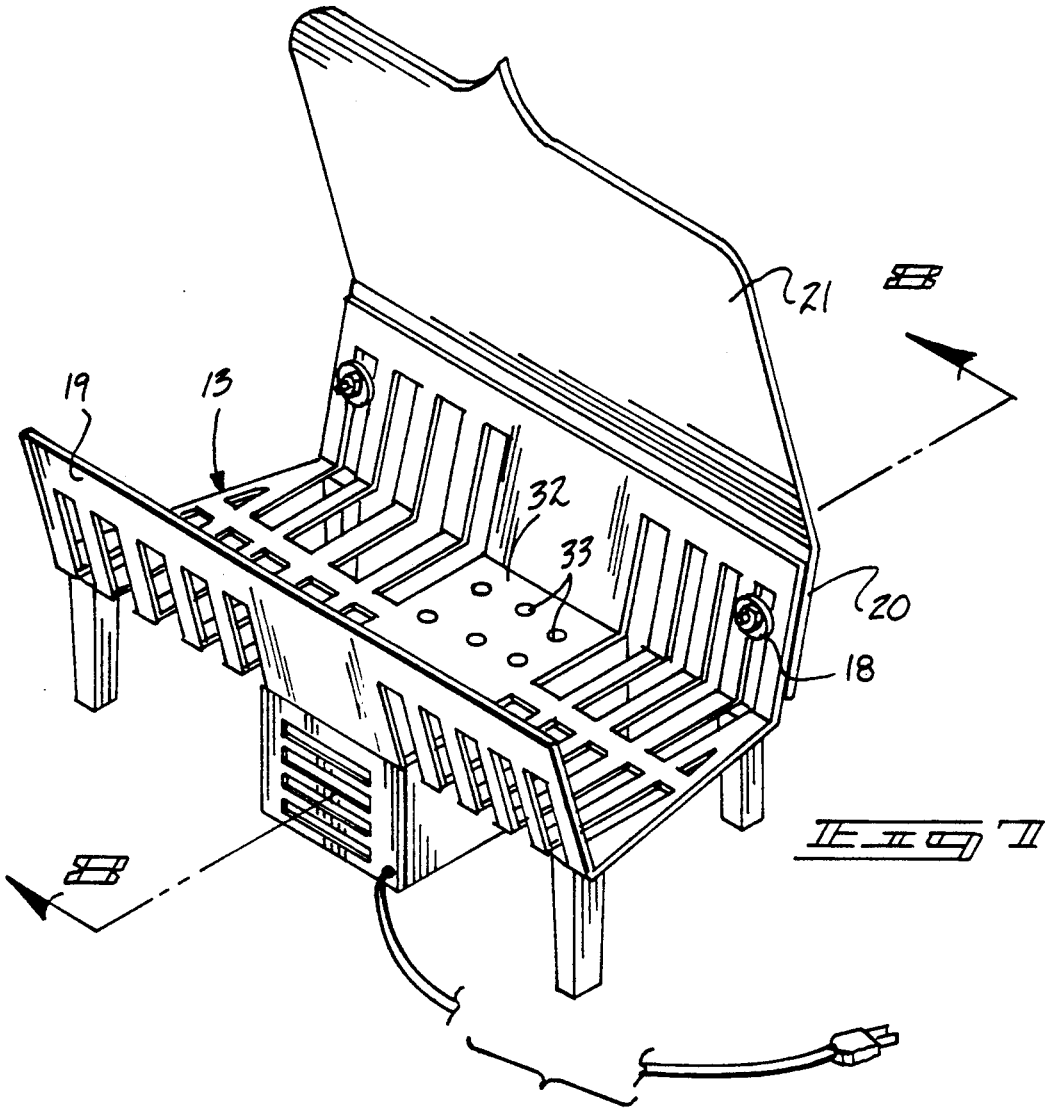
FIG. 7 is an isometric illustration of the invention further employing a ventilation structure arranged for mounting to a floor portion of the grate.

In the FIGS. 2 and 5 for example, the fireplace hearth 11 is provided with a hearth rear wall 12, typically of an angulated configuration arranged to deflect heat to a room area in communication with the hearth 11.

A support grate is provided of a generally U-shaped configuration, having a rear wall 18 and a forward wall 19, as well as a floor portion extending between the forward and rear walls 19 and 18 respectively. The shield structure further includes a first plate member 20 fixedly and continuously mounted to a second plate member 21 joined relative to one another at an obtuse included angle 22. The first plate includes a first plate first end and a first plate second end 23 and 24 respectively, with respective first and second parallel slots 25 and 26 respectively positioned in adjacency relative to respective first and second ends 23 and 24. First and second fasteners 29 and 30 are arranged for projection through the first and second slots 25 and 26 and through the support grate rear wall 18 to affix the shield plate 17 to the support grate rear wall. It should be noted that the rear and forward walls, as well as the floor structure, is provided with air receiving slots 15 directed through the grate to enhance air circulation therethrough for directing such air to fuel positioned upon the grate, as well as having grate supporting legs 16 fixedly mounted to the floor portion of the grate to support the grate in a spaced relationship to an underlying floor of the hearth structure 11.

The first plate 20 is provided with a first plate lowermost edge 27, with spaced parallel positioning flanges 28 mounted to a rear wall of the first plate member 20, with the positioning flanges 28 arranged orthogonally relative to the first plate member rear wall to extend therebelow the lowermost edge 27 to provide for proper spacing of the first plate relative to the hearth rear wall, as well as to the hearth floor. Further, a plurality of abutment lugs 31 are mounted to the second plate, and more specifically to the second plate rear wall to properly space the second plate relative to the hearth rear wall to provide for an air barrier between the shield structure 17 and the hearth rear wall, and accordingly minimize deterioration and damage from heat application to the hearth rear wall in use.

Figure 8:
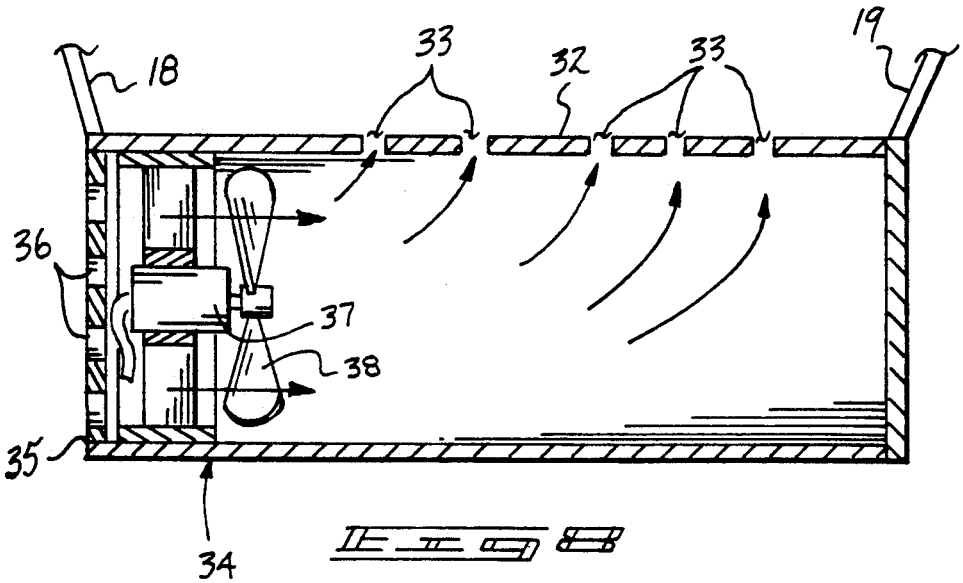
FIG. 8 is an orthographic view, taken along the lines 8—8 of FIG. 7 in the direction indicated by the arrows.

The FIG. 8 indicates the use of a grate central floor portion 32 having a matrix of floor apertures 33 directed therethrough in communication with an air box 34. The central floor includes an air box rear wall 35 having air box openings 36 positioned in adjacency relative to the grate forward wall 19, whereupon the blower motor 37 within the air box in adjacency to the air box rear wall 35 by the fan member 38 directs air from the rear wall openings 36 through the floor apertures 33 to enhance heating of fuel positioned upon the grate structure 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A fireplace shield arrangement within a fireplace hearth, wherein the hearth includes a hearth rear wall and a hearth floor, wherein the fireplace shield comprises, a support grate of a generally U-shaped configuration, having a grate rear wall spaced from a grate forward wall, and a grate floor portion extending between the grate forward wall and the grate rear wall, and the fireplace shield mounted to the grate rear wall extending above the grate rear wall, and the grate including a plurality of leg members arranged to space the grate floor portion above the hearth floor, and the shield plate includes a first plate member and a second plate member secured together, with the first plate member canted over the grate central floor portion and defining an obtuse included angle between the first plate member and the second plate member, and the first plate member including a first plate first end spaced from a first plate second end, and a first plate lowermost edge, and a first slot directed through the first plate in adjacency to the first end and a second slot directed through the first plate second end, and a first fastener directed through the first slot and the grate rear wall, and a second fastener directed through the second slot and the grate rear wall, and including a plurality of spaced parallel positioning flanges, and the first plate having a first plate rear wall and a first plate forward wall, with the first plate forward wall arranged in contiguous communication with the grate rear wall, and the first plate rear wall including the positioning flanges orthogonally mounted thereto, wherein the positioning flanges extend below the first plate lowermost edge to space the first plate relative to the hearth floor and the hearth rear wall.

2. A fireplace shield as set forth in claim 1 wherein the second plate includes a second plate rear wall extending from the first plate rear wall, and a plurality of abutment lugs fixedly mounted to the second plate rear wall to space the second plate rear wall relative to the hearth rear wall.

3. A fireplace shield as set forth in claim 2 including an air box mounted to the hearth between the support legs and in contiguous communication with the central floor portion, and the central floor portion including a plurality of floor apertures directed through the central floor portion in communication with the air box, the air box including an air box rear wall positioned in adjacency relative to the grate forward wall, and the air box rear wall including a plurality of air box openings, and a blower motor mounted within the air box in adjacency to the air box rear wall, with the blower motor having a fan member to direct air from the air box rear wall through the floor apertures.

* * * * *